US010085522B1

(12) United States Patent
Huang

(10) Patent No.: US 10,085,522 B1
(45) Date of Patent: Oct. 2, 2018

(54) DUAL-ENTRY KEYRING

(71) Applicant: HAOS CO., LTD., Road Town Tortola (VG)

(72) Inventor: Chi-Chao Huang, Taoyuan (TW)

(73) Assignee: HAOS CO., LTD., Road Town Tortola (VG)

( * ) Notice: Subject to any disclaimer, the term of this patent is extended or adjusted under 35 U.S.C. 154(b) by 0 days.

(21) Appl. No.: 15/808,670

(22) Filed: Nov. 9, 2017

(30) Foreign Application Priority Data

Jul. 11, 2017 (TW) ..... 106123124 A
Jul. 11, 2017 (TW) ..... 106210151 U

(51) Int. Cl.
*A44B 15/00* (2006.01)
*E05B 19/00* (2006.01)

(52) U.S. Cl.
CPC ..... *A44B 15/002* (2013.01); *A44B 15/00* (2013.01); *E05B 19/00* (2013.01)

(58) Field of Classification Search
CPC ..... E05B 19/00; A44B 15/00; A44B 15/002; A44B 15/007
See application file for complete search history.

(56) References Cited

U.S. PATENT DOCUMENTS 603,247 A * 5/1898 Becker ..... A44B 15/00 24/598.2
1,110,873 A * 9/1914 Boye ..... A44B 15/00 24/3.6
1,462,205 A * 7/1923 Korns ..... A44B 15/00 70/458
2,292,563 A * 8/1942 Imhoff ..... A44B 15/00 224/217
2,410,951 A * 11/1946 Kuhnl ..... A44B 15/00 70/458
4,891,961 A * 1/1990 Tsamas ..... A44B 15/00 24/598.5
4,951,361 A * 8/1990 Stephens, Jr. ..... A44B 15/00 24/3.6
5,465,596 A * 11/1995 Park ..... A44B 15/00 24/3.6
5,996,191 A * 12/1999 Christler ..... A44B 15/00 24/36
6,845,644 B1 * 1/2005 Buckner ..... A44B 15/00 24/20 EE
7,093,468 B2 * 8/2006 Song ..... A44B 15/00 24/3.6
D666,407 S * 9/2012 Schoultz ..... D3/207
8,464,564 B2 6/2013 Von Shoultz
9,854,879 B2 * 1/2018 Barr ..... A44B 15/002

* cited by examiner

*Primary Examiner* — Christopher J Boswell
(74) *Attorney, Agent, or Firm* — Guice Patents PLLC

(57) ABSTRACT

A dual-entry keyring includes a ring body in a two-turn ring shape design, defining a first end and a second end respectively disposed at opposing top and bottom sides thereof beyond superimposition and a first press portion and a second press portion arranged between the first end and the second end to face toward each other and respectively outwardly curved so that a gap is defined between the first press portion and the second press portion. Further, the part of the first turn of the two-turn ring shape design of the ring body beyond the first press portion is closely abutted to the part of the second turn of the two-turn ring shape design of the ring body beyond the second press portion so that a stress point is formed at each of two opposite lateral sides of the gap between the first press portion and the second press portion.

5 Claims, 5 Drawing Sheets

DUAL-ENTRY KEYRING

BACKGROUND OF THE INVENTION

1. Field of the Invention

The present invention relates to ring buckle technology and more particularly, to a dual-entry keyring for receiving and keeping keys together.

2. Description of the Related Art

As life is getting more and more convenient, people commonly carry a number of keys, including gate key, door key, vehicle key, office key, and other types of keys. To facilitate arrangement and use, people usually will use a keyring to keep keys together.

To meet such convenience, a variety of keyring and keychain designs of different types of structure and material or different key mounting measures have been created and have appeared on the market. However, to secure the keys most keyrings are made relatively stiff and therefore hard to open, i.e. putting on a key may be rather cumbersome. Moreover, the stiffness may lead to nails breaking when attempting to open up a keyring. U.S. Pat. No. 8,464,564 discloses an elegant and cost-efficient design that solves the above-mentioned problem.

According to U.S. Pat. No. 8,464,564, the keyring comprises a wire arranged in at least two rounds providing a resilient spiral. The spiral has a first and a second end, wherein the first end by means of inertial resiliency is forced to tightly contact a first surface of a lower round and the second end is forced to tightly contact a second surface of an upper round wherein at least one end is openable, by means of arranging a peak providing a compressible gap between the at least two rounds. This keyring design is functional, however, it is rather complex and inconvenient in use.

SUMMARY OF THE INVENTION

The present invention has been accomplished under the circumstances in view. It is one object of the present invention to provide a dual-entry keyring of high durability and cost-effectiveness, which utilizes the principle of lever for allowing a key to be easily attached onto one of two opposite ends thereof and then turned into the inside of the ring body of the keyring through 180° angle with less effort.

To achieve this and other objects of the present invention, a dual-entry keyring comprises a ring body in a two-turn ring shape design. The ring body comprises a first end and a second end respectively disposed at opposing top and bottom sides thereof beyond superimposition, and a first press portion and a second press portion arranged between the first end and the second end to face toward each other and respectively outwardly curved with a gap defined therebetween. Further, the part of the first turn of the two-turn ring shape design of the ring body beyond the first press portion is closely abutted to the part of the second turn of the two-turn ring shape design of the ring body beyond the second press portion so that a stress point is formed at each of two opposite lateral sides of the gap between the first press portion and the second press portion.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
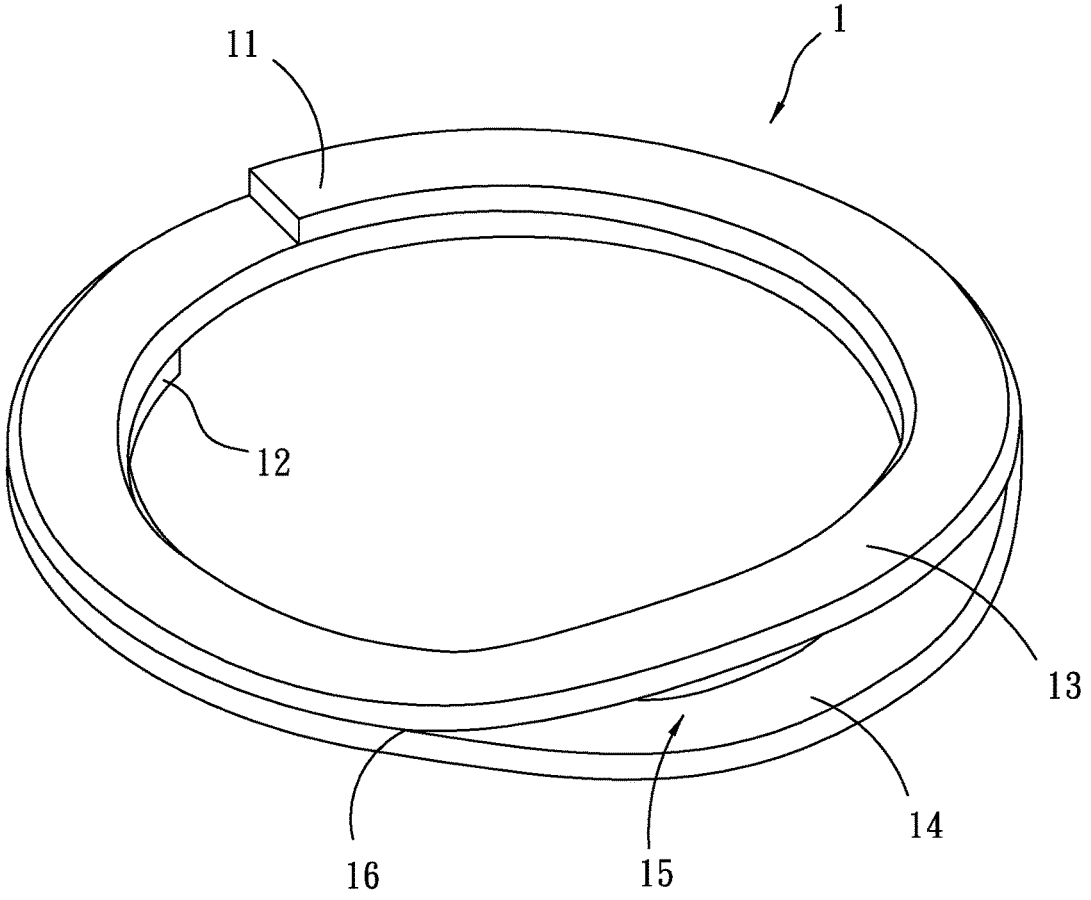
FIG. 1 is an oblique top elevational view of a dual-entry keyring in accordance with the present invention.
Figure 2:
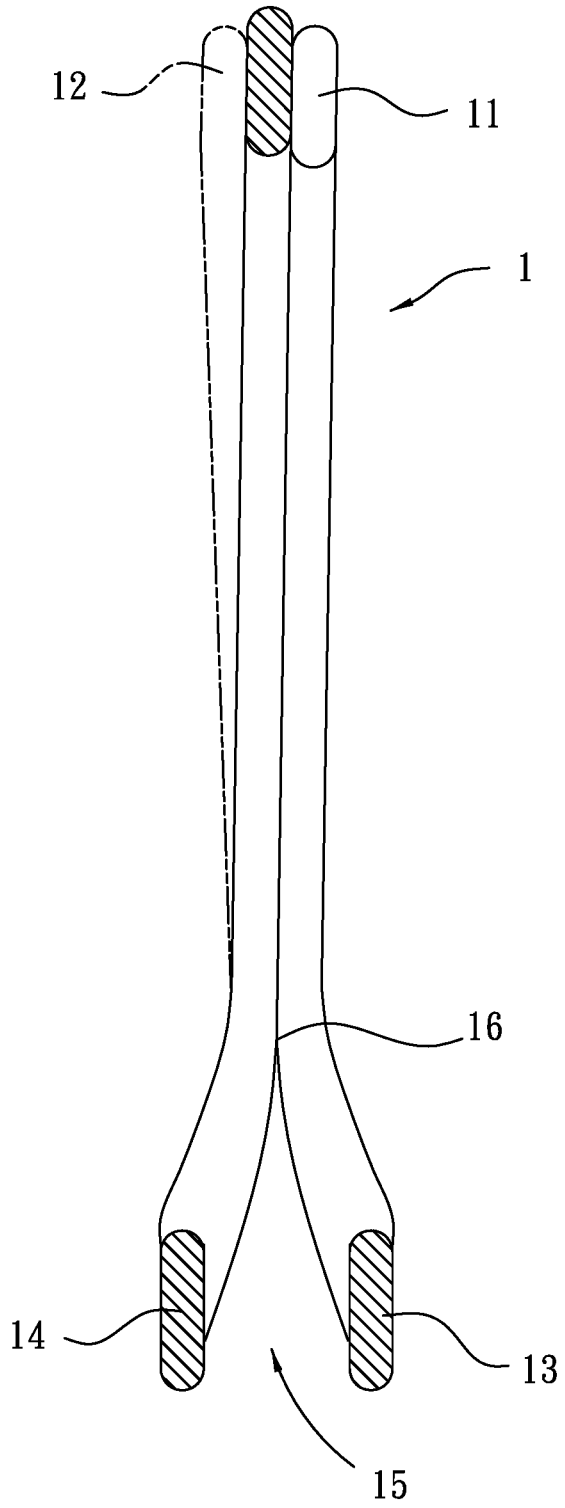
FIG. 2 is a schematic sectional view of the dual-entry keyring in accordance with the present invention.

Referring to FIGS. 1 and 2, a dual-entry keyring in accordance with the present invention is shown. The dual-entry keyring comprises a ring body 1. In this embodiment, the ring body 1 exhibits a two-turn ring shape design. The ring body 1 is made from a rigid material in a spiral form. In this embodiment, the ring body 1 comprises a first end 11 and a second end 12 respectively disposed at opposing top and bottom sides thereof beyond superimposition. The ring body 1 further comprises a first press portion 13 and a second press portion 14 arranged between the first end 11 and the second end 12 to face toward each other, and respectively outwardly curved so that a gap 15 is defined between the first press portion 13 and the second press portion 14. Further, the first end 11 and the first press portion 13 are formed in one turn, namely, the first turn of the two-turn ring shape design of the ring body 1, the second end 12 and the second press portion 14 are formed in the other turn, namely, the second turn of the two-turn ring shape design of the ring body 1. The part of the first turn of the two-turn ring shape design of the ring body 1 beyond the first press portion 13 is closely abutted to the part of the second turn of the two-turn ring shape design of the ring body 1 beyond the second press portion 14 so that a stress point 16 is formed at each of two opposite lateral sides of the gap 15 between the first press portion 13 and the second press portion 14. In this embodiment, as illustrated in FIG. 2, the first press portion 13 is on the same plane as the first end 11; the second press portion 14 is on the same plane as the second end 12.

Figure 3:
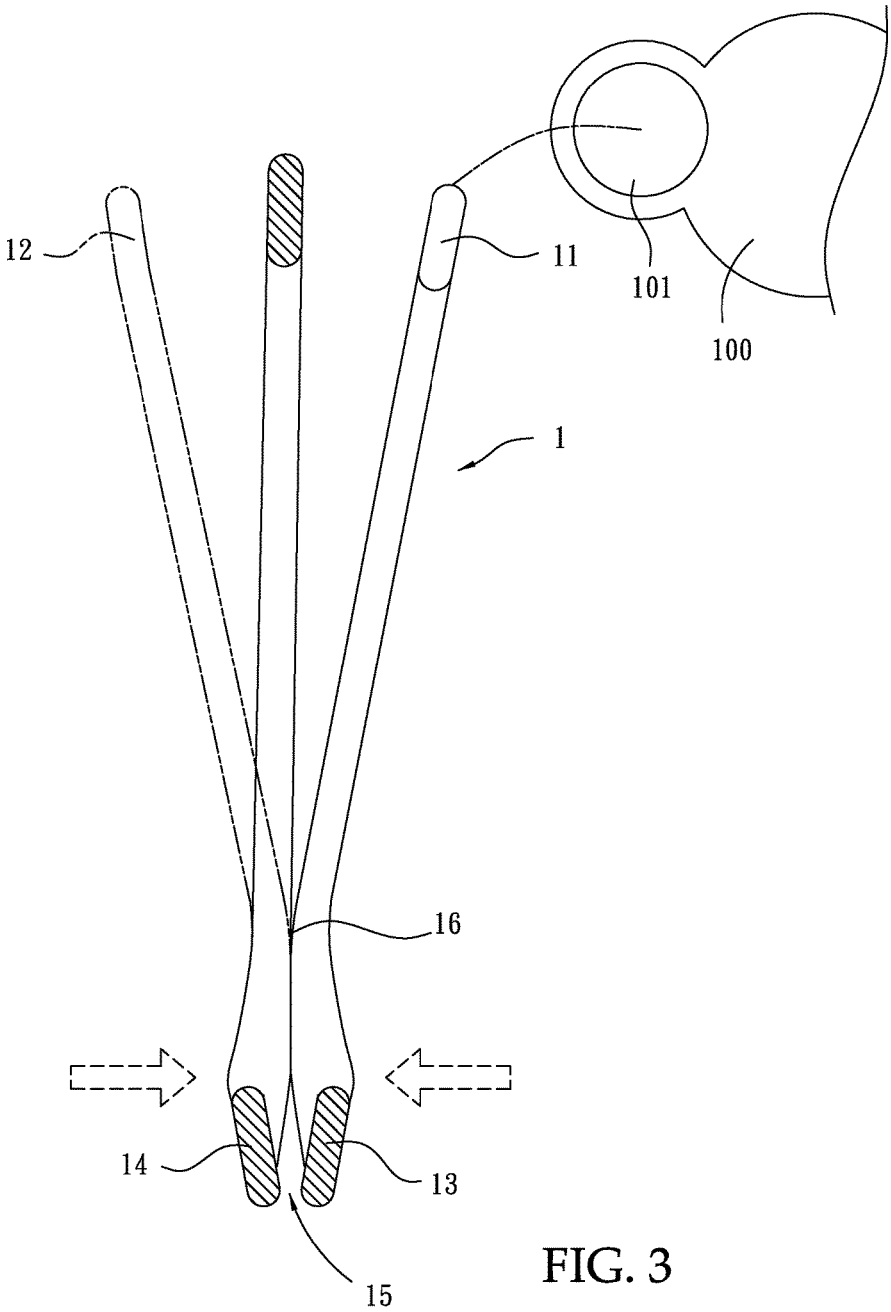
FIG. 3 is a schematic operational view of the present invention, illustrating one application example of the dual-entry keyring in accordance with the present invention (I).
Figure 4:
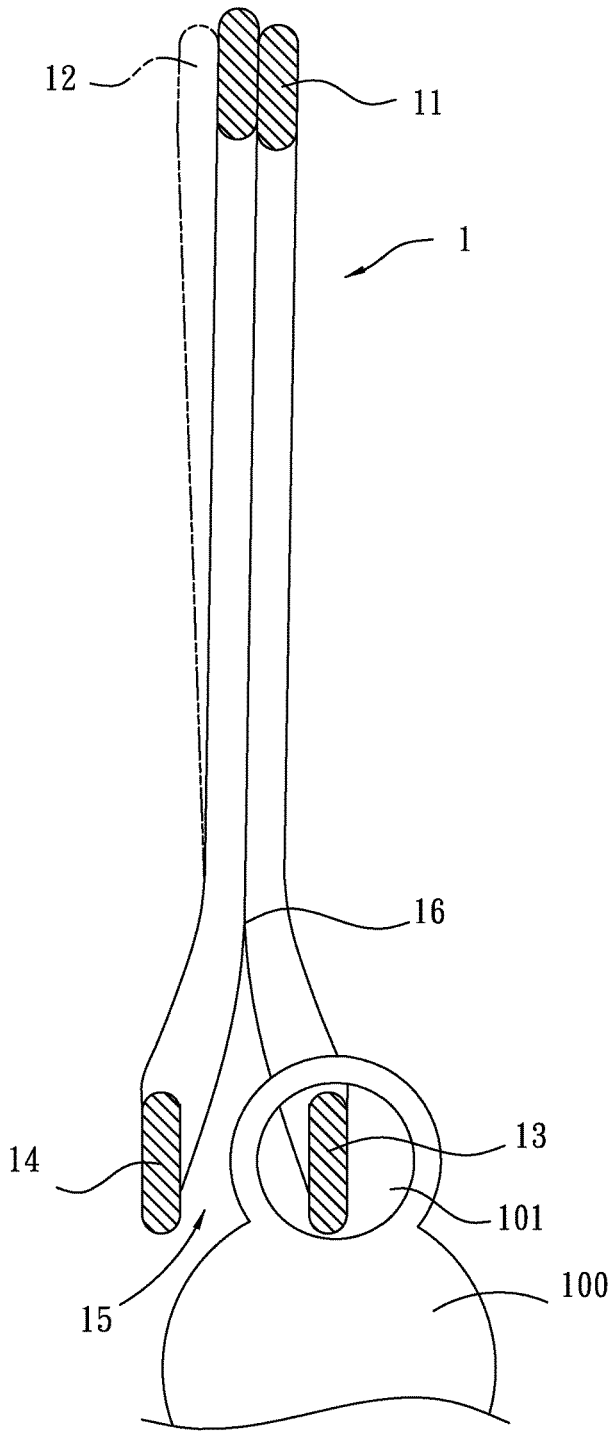
FIG. 4 is a schematic operational view of the present invention, illustrating one application example of the dual-entry keyring in accordance with the present invention (II).

Referring to FIG. 3, when using the dual-entry keyring, apply a pressure to the first press portion 13 and the second press portion 14 to compress the gap 15. At this time, each stress point 16 works as the fulcrum to carry out a lever-principle experiment, causing the first end 11 and the second end 12 to tilt up at the same time, causing the ring body 1 to provide an entry for allowing a ring hole 101 of a key 100 to be selectively attached onto the first end 11 or the second end 12 and then moved to the first press portion 13 through 180° maximum (i.e., half turn of the two-turn ring shape design of the ring body 1), and thus, the key 100 is held in the ring body 1, as illustrated in FIG. 4. Thus, the keyring structure of the present invention is convenient in use and still retains its durability for keeping keys.

Figure 5:
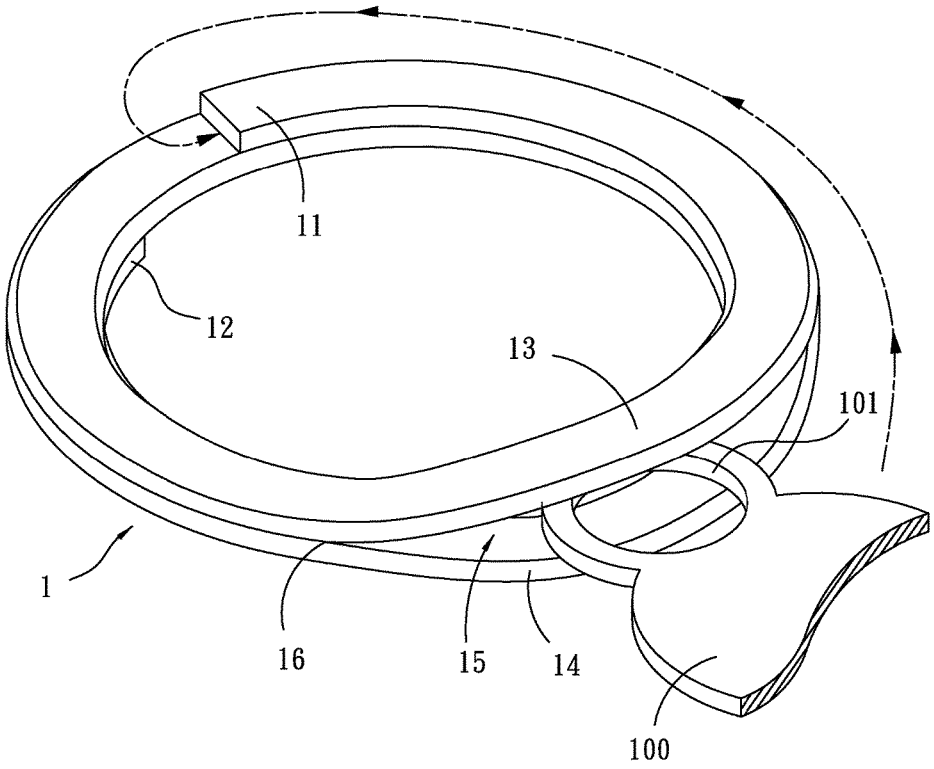
FIG. 5 is a schematic operational view of the present invention, illustrating another application example of the dual-entry keyring.

FIG. 5 illustrates another application example of the present invention. When using the dual-entry keyring to hold a key 100, insert the key 100 into the gap 15 in a parallel manner relative to the ring body 1, and then move the key 100 along the ring body 1 in the arrowhead direction as illustrated in the drawing through 180°. In the movement of the key 100 toward the first end 11 or second end 12, the body of the key 100 stretches open the double layer structure of the ring body 1. As soon as the key 100 reaches, for example, the first end 11, the first end 11 is tiled up for allowing the ring hole 101 of a key 100 to be attached onto the first end 11. Thus, according to this second application example, the user can attach the key 100 onto the first end 11 or second end 12 without pressing the first press portion 13 and the second press portion 14.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A dual-entry keyring, comprising:

a ring body in a two-turn ring shape design for keeping keys, said ring body comprising a first end and a second end respectively disposed at opposing top and bottom sides thereof beyond superimposition, and a first press portion and a second press portion arranged between said first end and said second end to face toward each other and respectively outwardly curved with a gap defined therebetween, a part of a first turn of said two-turn ring shape design of said ring body beyond said first press portion being closely abutted to a part of a second turn of said two-turn ring shape design of said ring body beyond said second press portion so that a stress point is formed at each of two opposite lateral sides of said gap between said first press portion and said second press portion;

wherein the ring body is made of a material having a thickness and a cross section being substantially rectangular and uniform along a length thereof, a first flat surface and a second flat surface extending along the length thereof from the first end to the second end of the ring body, the second flat surface is located opposite the first flat surface;

wherein, when the first end and the second end of the ring body engage a middle portion of the ring body, the first end and the second end of the ring body are spaced apart by a distance equal to the thickness of the ring body.

2. The dual-entry keyring as claimed in claim 1, wherein said first end and said first press portion is formed in the first turn of said two-turn ring shape design of said ring body; said second end and said second press portion is formed in the second turn of said two-turn ring shape design of said ring body.

3. The dual-entry keyring as claimed in claim 1, wherein said first press portion is on the same plane as said first end; said second press portion is on the same plane as said second end.

4. The dual-entry keyring as claimed in claim 1, wherein said ring body is made from a rigid material in a spiral form.

5. The dual-entry keyring as claimed in claim 1, wherein the maximum angle from one of said first end and said second end to one said stress point is 180°.

* * * * *